US011965445B1

(12) United States Patent
Oshima et al.

(10) Patent No.: US 11,965,445 B1
(45) Date of Patent: Apr. 23, 2024

(54) FASTENING STRUCTURE AND METHOD FOR DESIGNING FASTENING STRUCTURE

(71) Applicant: TOYOTA JIDOSHA KABUSHIKI KAISHA, Toyota (JP)

(72) Inventors: Tomoya Oshima, Susono (JP); Kohei Kodama, Shizuoka-ken (JP); Futoshi Yanai, Gotemba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/466,883

(22) Filed: Sep. 14, 2023

(30) Foreign Application Priority Data

Nov. 1, 2022 (JP) ..... 2022-175585

(51) Int. Cl.
*F01N 13/18* (2010.01)
*F01N 13/10* (2010.01)

(52) U.S. Cl.
CPC ..... *F01N 13/1805* (2013.01); *F01N 13/10* (2013.01); *F01N 13/1855* (2013.01); *F01N 2450/24* (2013.01)

(58) Field of Classification Search
CPC .. F01N 13/1805; F01N 13/10; F01N 13/1855; F01N 2450/24; F01N 13/1827; F01N 13/102; F01N 13/107; F01N 13/1811; F01N 13/1838; F16B 39/122; F16B 43/02; F16B 5/0241; F16B 5/025; F16L 23/032; F16L 39/00; F16L 41/086
See application file for complete search history.

(56) References Cited

U.S. PATENT DOCUMENTS

| | | | | |
|---|---|---|---|---|
| 5,918,912 | A * | 7/1999 | Keifel | F01N 13/1827 285/205 |
| 8,230,680 | B2 * | 7/2012 | Riekers | F01N 13/102 60/322 |
| 9,719,414 | B2 * | 8/2017 | Chu | F02B 37/16 |
| 10,480,534 | B2 * | 11/2019 | Mahalatkar | F04D 25/024 |
| 10,781,743 | B2 * | 9/2020 | Uchibori | F01M 13/00 |
| 11,098,636 | B2 * | 8/2021 | Wolk | F01N 5/04 |
| 11,236,660 | B2 * | 2/2022 | Arminjon | F01N 13/1827 |
| 2015/0377088 | A1 * | 12/2015 | Fujiwara | F01L 1/047 123/90.1 |
| 2017/0227043 | A1 | 8/2017 | Mohr et al. | |

FOREIGN PATENT DOCUMENTS

| | | | |
|---|---|---|---|
| DE | 10 2010 025 657 | A1 | 1/2012 |
| DE | 10 2011 009 340 | A1 | 7/2012 |
| EP | 3 203 048 | A1 | 8/2017 |
| WO | WO 2015/049023 | A1 | 4/2015 |
| WO | WO 2018/104070 | A2 | 6/2018 |

* cited by examiner

*Primary Examiner* — Jesse S Bogue
(74) *Attorney, Agent, or Firm* — Oblon, McClelland, Maier & Neustadt, L.L.P.

(57) ABSTRACT

In a fastening structure that fastens an exhaust manifold to a cylinder head of an engine, a bolt that extends through a flange is inserted into and fixed to a bolt hole of the cylinder head. The flange includes a contact surface that contacts a coupling surface of the cylinder head, and an inclined surface that is inclined with respect to the contact surface. A clearance is provided between the bolt and the cylinder head inside the bolt hole in a range extending from the coupling surface of the cylinder head to a specified length.

4 Claims, 7 Drawing Sheets

FASTENING STRUCTURE AND METHOD FOR DESIGNING FASTENING STRUCTURE

BACKGROUND

1. Field

The following description relates to a fastening structure and a method for designing a fastening structure.

2. Description of Related Art

European Patent Application Publication No. 3203048 discloses a fastening structure that fastens an exhaust manifold to a cylinder head of an engine.

The cylinder head has an opening of an exhaust port that is open to the outside of the cylinder head. A branch pipe of the exhaust manifold has an end with a flange. The flange is fastened to a coupling surface that surrounds the opening of the exhaust port so that the opening of the exhaust manifold is connected to the opening of the exhaust port.

The thickness of the flange decreases as the flange becomes farther from the branch pipe. Specifically, the flange includes a contact surface that contacts the coupling surface and an inclination surface that is inclined with respect to the contact surface. A bolt extends through the inclination surface of the flange and is inserted into a bolt hole provided in the cylinder head. A nut is fastened to the bolt so that a compression force is applied to the inclination surface of the flange. This fastens the exhaust manifold to the cylinder head.

The above fastening structure was designed taking into consideration the relationship between the static friction coefficient of the inclination surface and the angle of the inclination surface with respect to the contact surface. Accordingly, the effects of thermal expansion of the fastening structure were not considered when the fastening structure was designed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a fastening structure fastens an exhaust manifold to a cylinder head of an engine. The fastening structure includes an exhaust port of the cylinder head, a flange arranged on an end of a branch pipe of the exhaust manifold, a fixing member, a bolt, and a nut. The cylinder head includes an opening of the exhaust port that is open to outside of the cylinder head. The flange is fastened to a coupling surface that surrounds the opening of the exhaust port to connect an opening of the exhaust manifold to the opening of the exhaust port. The flange includes a first end portion and a second end portion that contact the coupling surface and are located at opposite sides of the branch pipe. The fixing member fixes the first end portion of the flange to the cylinder head. The bolt extends through the second end portion of the flange. The bolt is inserted into and fixed to a bolt hole of the cylinder head. The nut is fastened to the bolt to fix the second end portion of the flange to the cylinder head. A direction orthogonal to the coupling surface that contacts the second end portion of the flange defines a first direction. A direction in which the first end portion and the second end portion of the flange are located next to each other defines a second direction. A direction orthogonal to the first direction and the second direction defines a third direction. As viewed in the third direction, the second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe. The nut is fastened to the bolt so that a compression force is applied to the inclined surface. When "$x_0$" represents a length of a part of the bolt that is not in contact with a wall of the bolt hole and is from where the nut applies the compression force to the inclined surface to where the bolt contacts the wall of the bolt hole in a cross section taken along a plane extending along the second direction and a center axis of the bolt when the fastening structure is not thermally expanded; "$\Delta x$" represents an amount of deformation of the bolt in an axial direction of the bolt resulting from thermal expansion of the fastening structure; "$\Delta F$" represents an amount of change in the force of the nut that compresses the second end portion resulting from thermal expansion of the fastening structure in the cross section; "$\theta$" represents an angle of the inclined surface with respect to the contact surface in the cross section; "l" represents a distance from a distal end of the first end portion of the contact surface of the flange to a center of the bolt hole in the cross section when the fastening structure is not thermally expanded; "$\alpha_h$" represents a coefficient of linear expansion of the cylinder head in the cross section; "$\alpha_f$" represents a coefficient of linear expansion of the flange; "$\alpha b$" represents a coefficient of linear expansion of the bolt; "$\Delta T_h$" represents a temperature change of the cylinder head during thermal expansion of the fastening structure; "$\Delta T_f$" represents a temperature change of the flange during thermal expansion of fastening structure; "$\Delta T_b$" represents a temperature change of the bolt during thermal expansion of the fastening structure; "$K_f$" represents a spring constant of the flange at a part where the flange is held between the cylinder head and the bolt in the cross section when the fastening structure is not thermally expanded; "$K_b$" represents a spring constant of the bolt in the axial direction of the bolt; "$F_C$" represents a limit load at which any of the cylinder head, the flange, or the bolt undergoes plastic deformation; "$\Delta x_c$" represents a limit displacement at which any of the flange or the bolt undergoes plastic deformation; and "$\varepsilon_{bc}$" represents a limit strain at which the bolt undergoes plastic deformation in the axial direction of the bolt;

$$\Delta F = \frac{K_b K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta x = x_0 \alpha_b \Delta T_b + l\sin\theta \cdot \alpha_h \Delta T_h + \frac{K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta F < F_c$$

-continued $$\Delta x < \Delta x_c$$

$$\varepsilon = \frac{\Delta x}{x_0} < \varepsilon_{bc}$$

the above equations are satisfied.

In another general aspect, a fastening structure fastens an exhaust manifold to a cylinder head of an engine. The fastening structure includes an exhaust port of the cylinder head, a flange arranged on an end of a branch pipe of the exhaust manifold, a fixing member, a bolt, a nut, and a clearance. The cylinder head includes an opening of the exhaust port that is open to outside of the cylinder head. The flange is fastened to a coupling surface that surrounds the opening of the exhaust port to connect an opening of the exhaust manifold to the opening of the exhaust port. The flange includes a first end portion and a second end portion that contact the coupling surface and are located at opposite sides of the branch pipe. The fixing member fixes the first end portion of the flange to the cylinder head. The bolt extends through the second end portion of the flange. The bolt is inserted into and fixed to a bolt hole of the cylinder head. The nut is fastened to the bolt to fix the second end portion of the flange to the cylinder head. The second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe. The nut, fastened to the bolt that extends through the inclined surface, contacts the inclined surface. The clearance is provided between the bolt and the cylinder head inside the bolt hole, and extends in a range extending from the coupling surface of the cylinder head to a specified length.

In another general aspect, a method is for designing a fastening structure that fastens an exhaust manifold to a cylinder head of an engine. The fastening structure includes an exhaust port of the cylinder head, a flange arranged on an end of a branch pipe of the exhaust manifold, a fixing member, a bolt, and a nut. The cylinder head includes an opening of the exhaust port that is open to outside of the cylinder head. The flange is fastened to a coupling surface that surrounds the opening of the exhaust port to connect an opening of the exhaust manifold to the opening of the exhaust port. The flange includes a first end portion and a second end portion that contact the coupling surface and are located at opposite sides of the branch pipe. The fixing member fixes the first end portion of the flange to the cylinder head. The bolt extends through the second end portion of the flange. The bolt is inserted into and fixed to a bolt hole of the cylinder head. The nut is fastened to the bolt to fix the second end portion of the flange to the cylinder head. A direction orthogonal to the coupling surface that contacts the second end portion of the flange defines a first direction. A direction in which the first end portion and the second end portion of the flange are located next to each other defines a second direction. A direction orthogonal to the first direction and the second direction defines a third direction. As viewed in the third direction, the second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe. The nut is fastened to the bolt so that a compression force is applied to the inclined surface. When "$x_0$" represents a length of a part of the bolt that is not in contact with a wall of the bolt hole and is from where the nut applies the compression force to the inclined surface to where the bolt contacts the wall of the bolt hole in a cross section taken along a plane extending along the second direction and a center axis of the bolt when the fastening structure is not thermally expanded; "$\Delta x$" represents an amount of deformation of the bolt in an axial direction of the bolt resulting from thermal expansion of the fastening structure; "$\Delta F$" represents an amount of change in the force of the nut that compresses the second end portion resulting from thermal expansion of the fastening structure in the cross section; "$\theta$" represents an angle of the inclined surface with respect to the contact surface in the cross section; "l" represents a distance from a distal end of the first end portion of the contact surface of the flange to a center of the bolt hole in the cross section when the fastening structure is not thermally expanded; "$\alpha_h$" represents a coefficient of linear expansion of the cylinder head in the cross section; "$\alpha_f$" represents a coefficient of linear expansion of the flange; "$\alpha b$" represents a coefficient of linear expansion of the bolt; "$\Delta T_h$" represents a temperature change of the cylinder head during thermal expansion of the fastening structure; "$\Delta T_f$" represents a temperature change of the flange during thermal expansion of fastening structure; "$\Delta T_b$" represents a temperature change of the bolt during thermal expansion of the fastening structure; "$K_f$" represents a spring constant of the flange at a part where the flange is held between the cylinder head and the bolt in the cross section when the fastening structure is not thermally expanded; "$K_b$" represents a spring constant of the bolt in the axial direction of the bolt; "$F_C$" represents a limit load at which any of the cylinder head, the flange, or the bolt undergoes plastic deformation; "$\Delta x_c$" represents a limit displacement at which any of the flange or the bolt undergoes plastic deformation; and "$\varepsilon_{bc}$" represents a limit strain at which the bolt undergoes plastic deformation in the axial direction of the bolt;

$$\Delta F = \frac{K_b K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta x = x_0 \alpha_b \Delta T_b + l\sin\theta \cdot \alpha_h \Delta T_h + \frac{K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta F < F_c$$

$$\Delta x < \Delta x_c$$

$$\varepsilon = \frac{\Delta x}{x_0} < \varepsilon_{bc}$$

the method includes designing the fastening structure such that the above equations are satisfied.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A fastening structure and a method for designing a fastening structure in accordance with an embodiment will now be described with reference to the drawings.

Fastening Structure 100

A fastening structure 100 will now be described with reference to FIGS. 1 to 4.

Figure 1:
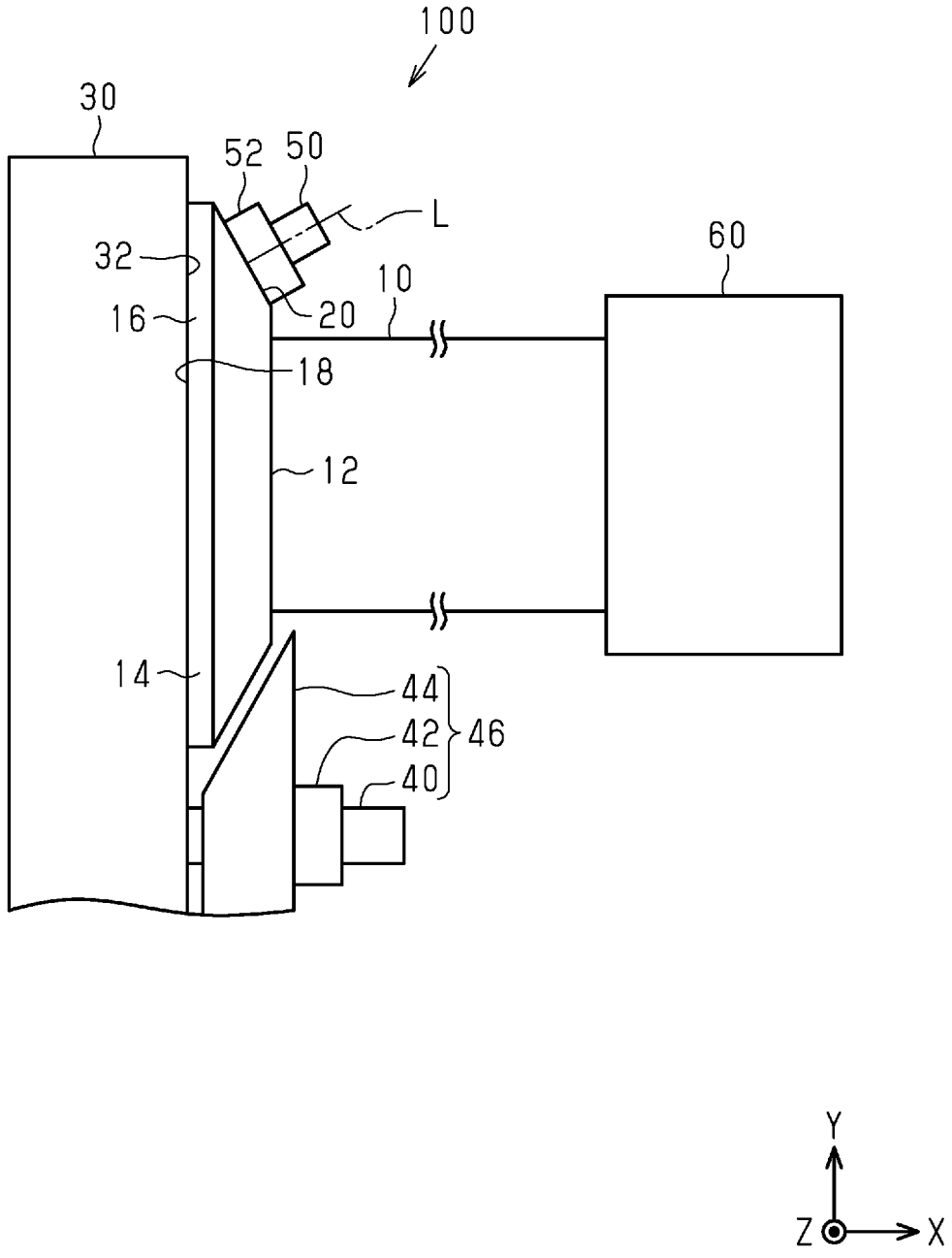
FIG. 1 is a schematic diagram of a fastening structure in accordance with an embodiment.

As shown in FIG. 1, the fastening structure 100 fastens an exhaust manifold 10 to a cylinder head 30 of an engine. An exhaust pipe 60 is arranged at a downstream side of the exhaust manifold 10.

Figure 2:
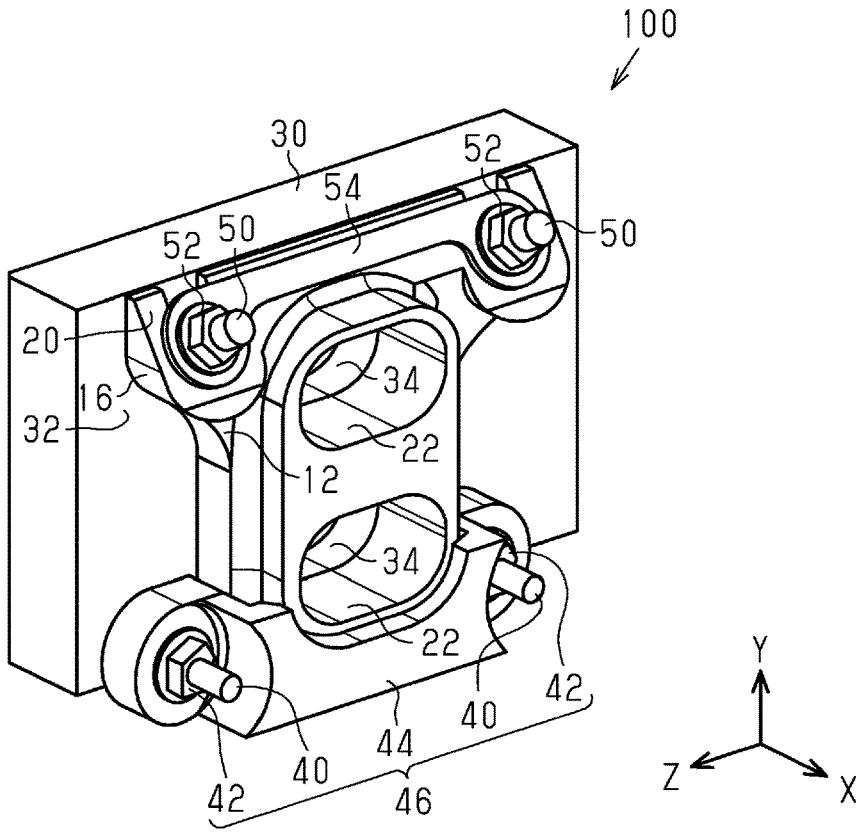
FIG. 2 is a perspective view of the fastening structure shown in FIG. 1 without a member at a downstream side of a flange.

As shown in FIG. 2, the cylinder head 30 includes two openings 34 of an exhaust port that are open to the outside of the cylinder head 30 for each cylinder. As shown in FIG. 1, a branch pipe of the exhaust manifold 10 has a flange 12 at an end thereof. The flange 12 is fastened to a coupling surface 32 that surrounds the openings 34 of the exhaust port. As shown in FIG. 2, two openings 22 of the exhaust manifold 10 are respectively connected to the two openings 34 of the exhaust port.

As shown in FIG. 1, the flange 12 includes a first end portion 14 and a second end portion 16 that contact the coupling surface 32 at opposite sides of the branch pipe of the exhaust manifold 10.

A structure for fastening the exhaust manifold 10 to the cylinder head 30 of the engine at the first end portion 14 shown in FIG. 1 will now be described. Two bolts 40, two nuts 42, and a lower holder 44 shown in FIG. 2 form a fixing member 46. The fixing member 46 fixes the first end portion 14 of the flange 12 to the cylinder head 30. Specifically, the fixing member 46 fixes the first end portion 14 of the flange 12 to the cylinder head 30 through the following procedures. First, the two bolts 40 are respectively inserted into two bolt holes of the cylinder head 30. The two bolts 40 extend parallel to a first direction X that is orthogonal to the coupling surface 32. Then, the lower holder 44 is set on the cylinder head 30 such that the two bolts 40 respectively extend through two through holes in the lower holder 44. Next, the two nuts 42 are respectively fastened to the two bolts 40. In this manner, the lower holder 44 and the cylinder head 30 form a pocket that receives the flange 12. The first end portion 14 of the flange 12 is inserted into the pocket.

Figure 3:
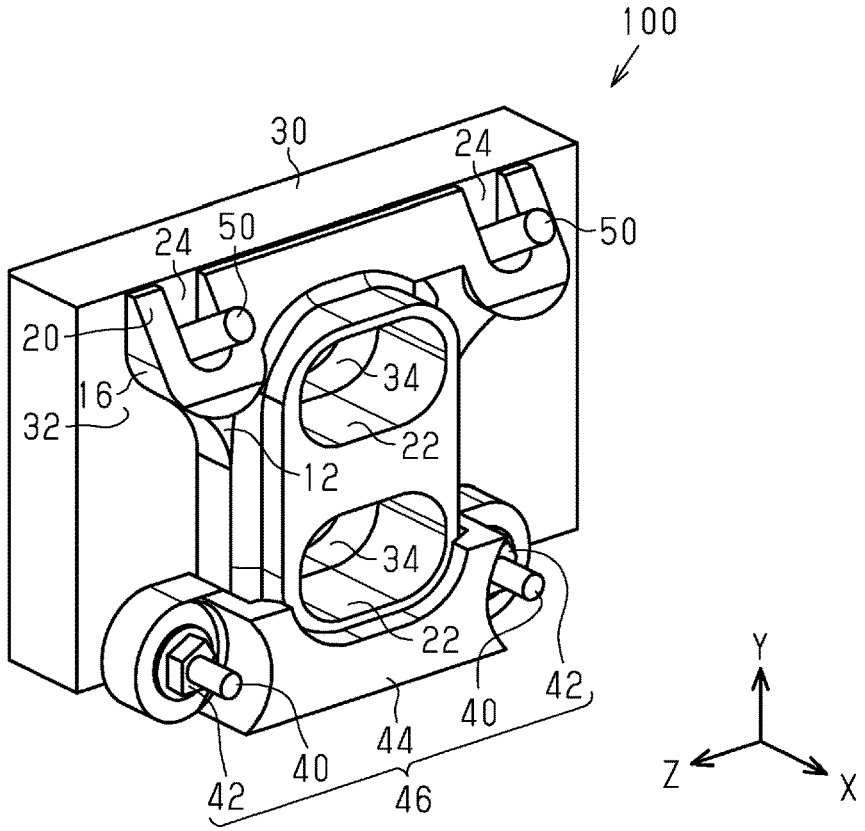
FIG. 3 is a perspective view of the fastening structure shown in FIG. 1 illustrating a cavity in which a bolt extends.

A structure for fastening the exhaust manifold 10 to the cylinder head 30 of the engine at the second end portion 16 will now be described. As shown in FIGS. 1 and 2, the second end portion 16 includes two bolts 50 which respectively project from two cavities 24 shown in FIG. 3. Each cavity 24 is open toward a side opposite to the first end portion 14. FIG. 3 is a perspective view of the fastening structure 100 without two nuts 52 and a washer 54 that are shown in FIG. 2. When inserting the first end portion 14 into the pocket, the two bolts 50 have already been inserted into and fixed to two bolt holes 36 of the cylinder head 30. Each cavity 24 is open toward the side opposite to the first end portion 14. This allows the flange 12 to be inserted into the pocket along the two bolts 50 such that the two bolts 50 extend in the two cavities 24 as shown in FIG. 3. Then, the washer 54 and the two nut 52 are fixed to each bolt 50 in this order.

As shown in FIG. 3, each bolt 50 does not contact the flange 12 in the cavity 24. This avoids the flange 12 from pressing the sides of the two bolts 50 when the flange 12 thermally expands. Therefore, when the flange 12 thermally expands, the flange 12 will not apply unnecessary force to the two bolts 50.

Figure 4:
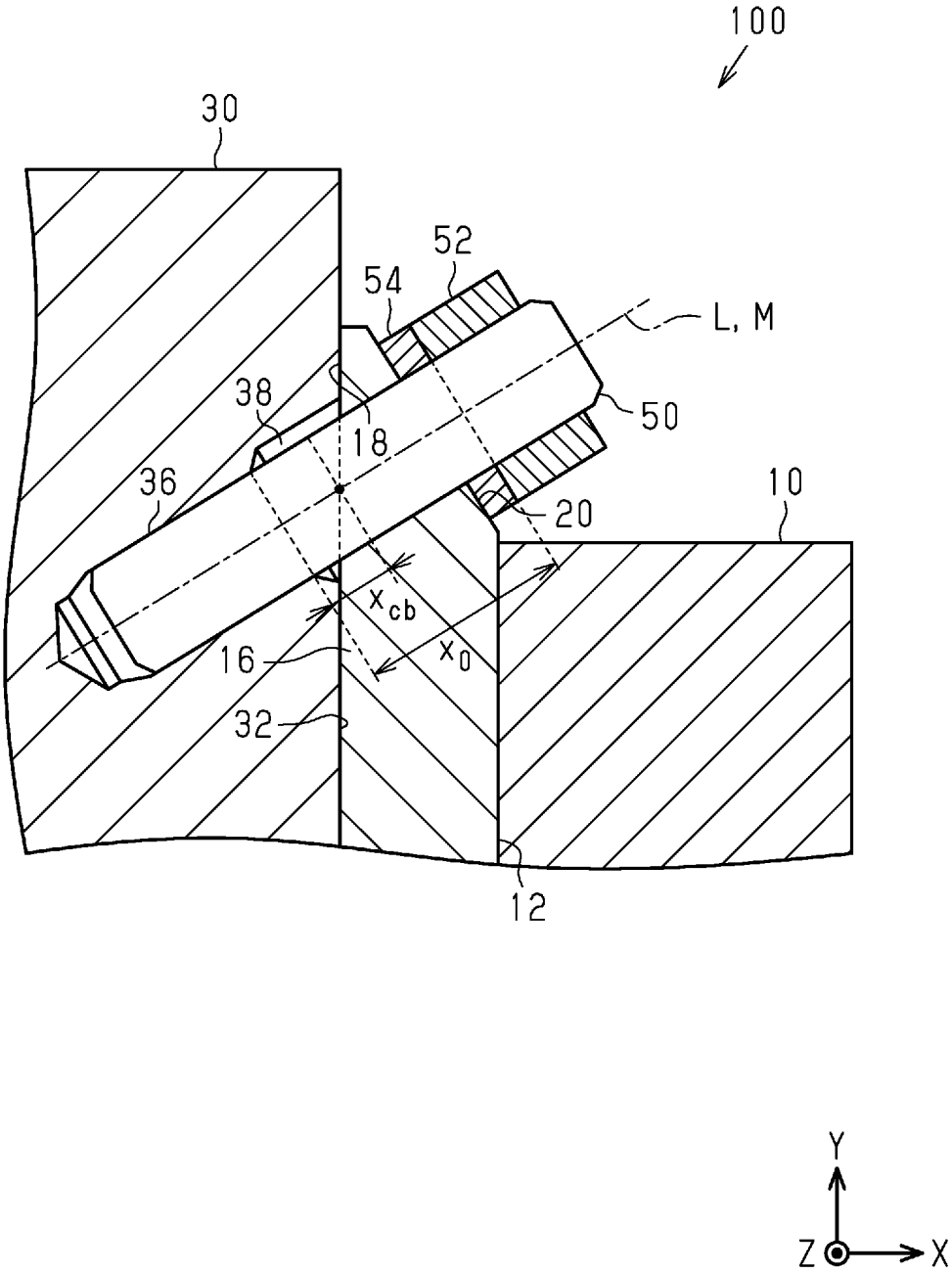
FIG. 4 is a cross-sectional view of the fastening structure shown in FIG. 1 enlarging an upper bolt.

As shown in FIG. 4, the bolt 50 extending through the second end portion 16 of the flange 12 is inserted into the bolt hole 36 of the cylinder head 30. The nut 52 is fastened to the bolt 50 to fix the second end portion 16 of the flange 12 to the cylinder head 30. A direction orthogonal to the coupling surface 32 that contacts the second end portion 16 of the flange 12 defines the first direction X. A direction in which the first end portion 14 and the second end portion 16 of the flange 12 are located next to each other defines a second direction Y. A direction orthogonal to the first direction X and the second direction Y defines a third direction Z. As viewed in the third direction Z, the second end portion 16 of the flange 12 includes a contact surface 18 and an inclined surface 20. The contact surface 18 contacts the coupling surface 32 of the cylinder head 30. The inclined surface 20 is inclined with respect to the contact surface 18 such that the inclined surface 20 becomes closer to the contact surface 18 as the inclined surface 20 becomes farther away from the branch pipe. The nut 52 is fastened to the bolt 50 so that a compression force is applied to the inclined surface 20 via the washer 54. A clearance 38 is provided between the bolt 50 and the cylinder head 30 inside the bolt hole 36 in a range extending from the coupling surface 32 of the cylinder head 30 to a specified length. In FIG. 4, "$x_{cb}$" represents the specified length.

Thermal Expansion of Typical Fastening Structure

Thermal expansion of a typical fastening structure differing from the present embodiment will now be described with reference to FIGS. 5 to 7 to facilitate understanding of the fastening structure 100 in accordance with the present embodiment. In the typical fastening structure, a bolt 1050 and a nut 1052 fix a flange 1012 to a cylinder head 1030. The bolt 1050 is perpendicular to a coupling surface 1032 of the cylinder head 1030.

Figure 5:
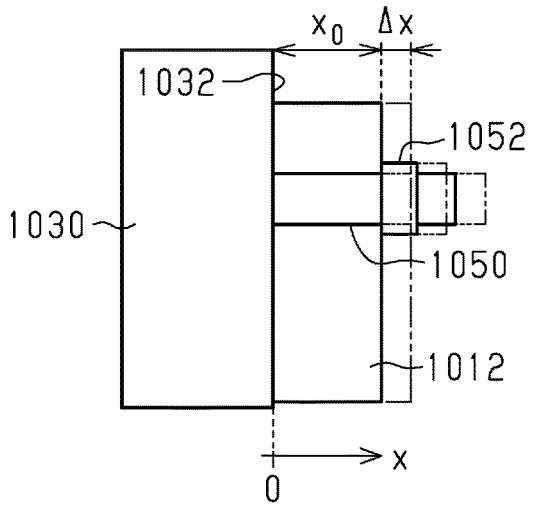
FIG. 5 is a diagram showing a typical fastening structure differing from the present embodiment to facilitate understanding of the fastening structure in accordance with the present embodiment.
Figure 6:
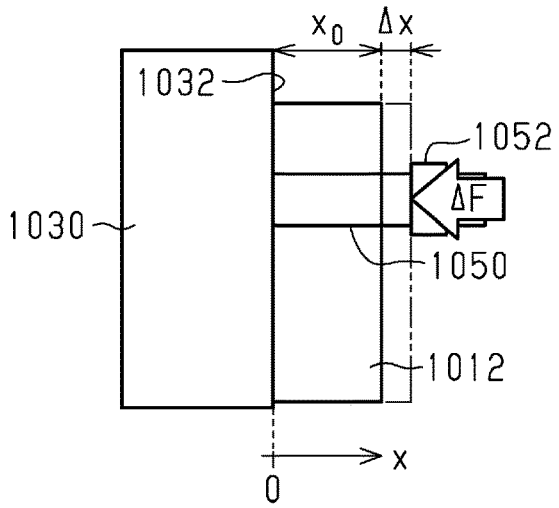
FIG. 6 is a diagram showing a force applied to a flange of the typical fastening structure shown in FIG. 5.
Figure 7:
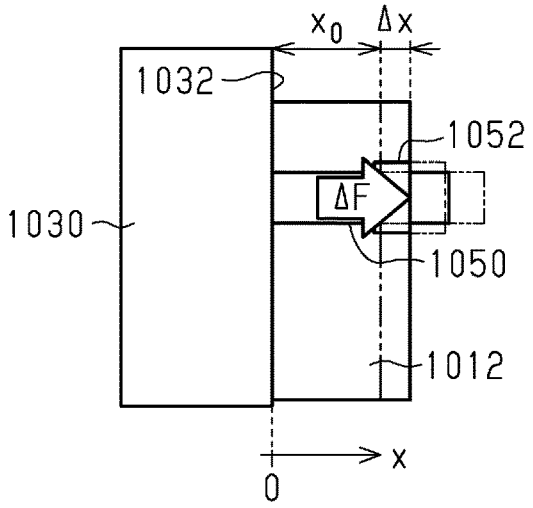
FIG. 7 is a diagram showing a force applied to a bolt of the typical fastening structure shown in FIG. 5.

In FIGS. 5 to 7, the flange 1012, the bolt 1050, and the nut 1052, before thermal expansion, are indicated by the solid lines. In FIGS. 5 to 7, the flange 1012, the bolt 1050, and the nut 1052, after thermal expansion, are indicated by the double-dashed lines.

The following parameters will be used in the description hereafter. "$x_0$" represents the thickness of the flange 1012 in an axial direction of the bolt 1050 before the flange 1012 thermally expands. "$x_0$" also represents the length of the bolt 1050 before the bolt 1050 thermally expands. "Δx" represents an amount of deformation of the flange 1012 in the axial direction of the bolt 1050 resulting from thermal expansion. "Δx" also represents an amount of deformation of the bolt 1050 resulting from thermal expansion. The force applied by the nut 1052 to the flange 1012 in the axial direction of the bolt 1050 will be referred to as the bolt axial force. "ΔF" represents a change in the bolt axial force resulting from thermal expansion. "$\alpha_f$" represents a coefficient of linear expansion of the flange 1012. "αb" represents a coefficient of linear expansion of the bolt 1050. "$\Delta T_f$" represents a temperature change of the flange 1012 during thermal expansion. "$\Delta T_b$" represents a temperature change of the bolt 1050 during thermal expansion. "$K_f$" represents a spring constant of the flange 1012 at a part where the flange 1012 is held between the cylinder head 1030 and the bolt 1050. "$K_b$" represents a spring constant of the bolt 1050 in the axial direction of the bolt 1050.

First, the flange 1012 will be discussed. If the flange 1012 were not constrained by the nut 1052, thermal expansion will increase the thickness of the flange 1012 by an amount corresponding to "$x_0 \times\times \alpha_f \times \Delta T_f$". The flange 1012 is, however, actually constrained by the nut 1052. This obtains a balanced state in which the bolt axial force changes by "ΔF" and the thickness of the flange 1012 changes by "Δx" when the flange 1012 thermally expands. Such a balanced state is shown in FIG. 6. Therefore, the amount of deformation "Δx" of the flange 1012 satisfies the following equation.

$$\Delta x = x_0 \alpha_f \Delta T_f - \frac{\Delta F}{K_f} \tag{1}$$

Next, the bolt 1050 will be discussed. If the flange 1012 were not provided, thermal expansion will increase the length of the bolt 1050 by an amount corresponding to "$x_0 \times \alpha_b \times \Delta T_b$". Thermal expansion, however, actually produces a force with the flange 1012 that stretches the bolt 1050 through the nut 1052. This obtains a balanced state in which the bolt axial force changes by "ΔF" and the thickness of the bolt 1050 changes by "Δx" when the bolt 1050 thermally expands. Such a balanced state is shown in FIG. 7. Therefore, the amount of deformation "Δx" of the bolt 1050 satisfies the following equation.

$$\Delta x = x_0 \alpha_b \Delta T_b + \frac{\Delta F}{K_b} \tag{2}$$

The following Equation (3) is obtained from Equations (1) and (2).

$$\Delta F = \frac{K_b K_f}{K_b + K_f} x_0 (\alpha_f \Delta T_f - \alpha_b \Delta T_b) \tag{3}$$

The following Equation (4) is obtained from Equations (1) and (3).

$$\Delta x = \frac{\alpha_f \Delta T_f K_f + \alpha_b \Delta T_b K_b}{K_b + K_f} x_0 \tag{4}$$

Thermal Expansion of Fastening Structure 100

Thermal expansion of the fastening structure 100 will now be described with reference to FIGS. 8 to 13. Thermal expansion of the fastening structure 100 can also be described in the same manner as that of the typical fastening structure.

Figure 8:
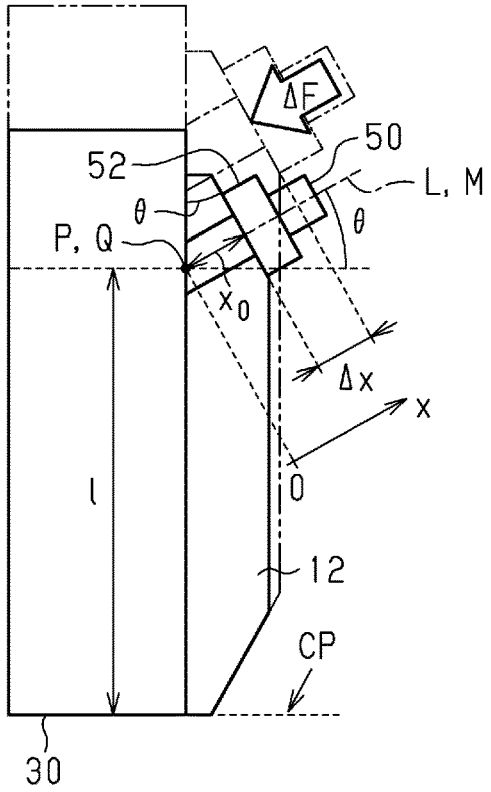
FIG. 8 is a diagram illustrating thermal expansion of the fastening structure shown in FIG. 1.

In FIGS. 8 to 13, the flange 12, the cylinder head 30, the bolt 50, and the nut 52, before thermal expansion, are indicated by the solid lines. In FIGS. 8 to 13, the flange 12, the cylinder head 30, the bolt 50, and the nut 52, after thermal expansion, are indicated by the double-dashed lines. FIGS. 8 to 13 are diagrams showing the fastening structure 100 as viewed in a cross section taken along a plane extending along the second direction Y and a center axis M of the bolt 50 shown in FIG. 4. As shown in FIG. 8, a contact point CP of the lower holder 44 and the flange 12 does not move even when the fastening structure 100 thermally expands.

The following parameters will be used in the description hereafter. Some parameters are defined in the cross section taken along a plane extending along the second direction Y and the central axis M of the bolt 50. In such a cross section, "$x_0$" represents a length of a part of the bolt 50 that is not in contact with a wall of the bolt hole 36 and is from a position where the nut 52 applies a compression force to the inclined surface 20 to where the bolt 50 contacts the wall of the bolt hole 36 before the fastening structure 100 thermally expands. "Δx" represents an amount of deformation of the bolt 50 in an axial direction of the bolt 50 resulting from thermal expansion of the fastening structure 100. "ΔF" represents an amount of change in the force of the nut 52 that compresses the second end portion 16 resulting from thermal expansion of the fastening structure 100 in the cross section. "θ" represents the angle of the inclined surface 20 with respect to the contact surface 18 in the cross section.

The angle is an acute angle. "l" represents the distance from a distal end of the first end portion 14 of the contact surface 18 of the flange 12 to the center of the bolt hole 36 in the cross section before the fastening structure 100 thermally expands. "$\alpha_h$" represents a coefficient of linear expansion of the cylinder head 30 in the cross section. "$\alpha_f$" represents a coefficient of linear expansion of the flange 12. "αb" represents a coefficient of linear expansion of the bolt 50. "ΔT h" represents a temperature change of the cylinder head 30 during thermal expansion of the fastening structure 100. "$\Delta T_f$" represents a temperature change of the flange 12 during thermal expansion of the fastening structure 100. "$\Delta T_b$" represents a temperature change of the bolt 50 during thermal expansion of the fastening structure 100. "$K_f$" represents a spring constant of the flange 12 at a part where the flange 12 is held between the cylinder head 30 and the bolt 50 in the cross section before the fastening structure 100 thermally expands. "$K_b$" represents a spring constant of the bolt 50 in the axial direction of the bolt 50. "$F_C$" represents a limit load at which any of the cylinder head 30, the flange 12, or the bolt 50 undergoes plastic deformation. "$\Delta x_c$" represents a limit displacement at which any of the flange 12 or the bolt 50 undergoes plastic deformation. "$\varepsilon_{bc}$" represents a limit strain in the axial direction of the bolt 50 at which the bolt 50 undergoes plastic deformation.

First, the flange 12 will be discussed. The amount of deformation "Δx" of the bolt 50 in the axial direction of the bolt 50 also represents the amount of deformation of the flange 12 in the axial direction of the bolt 50 resulting from thermal expansion.

As shown in FIG. 8, a center axis L of the bolt hole 36 before the fastening structure 100 thermally expands coincides with the central axis M of the bolt 50 before the fastening structure 100 thermally expands.

Figure 9:
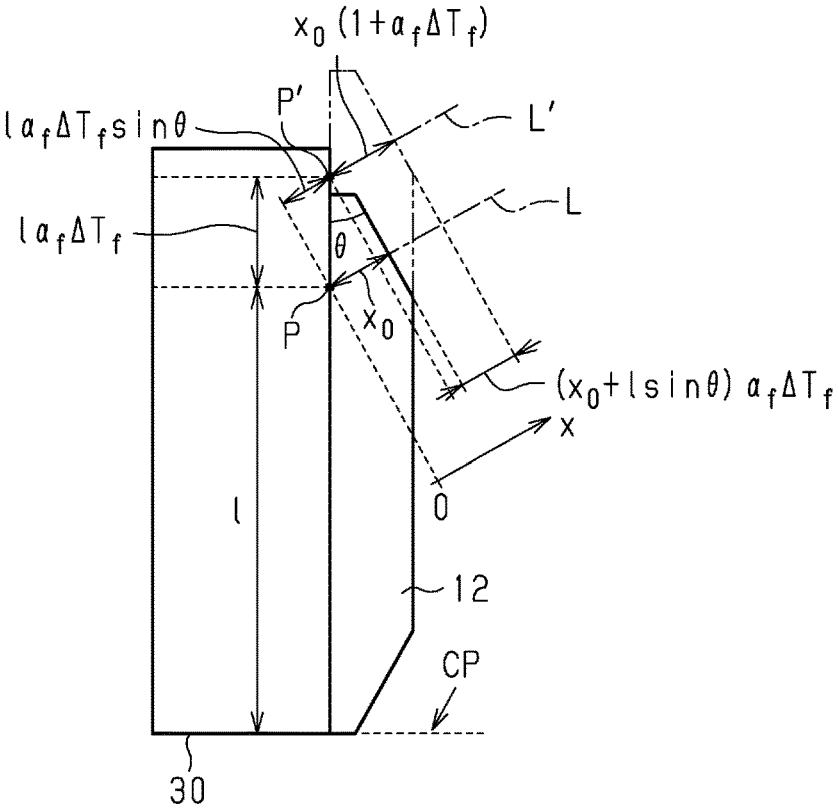
FIG. 9 is a diagram illustrating thermal expansion of the flange of the fastening structure shown in FIG. 1.

As shown in FIG. 9, as the flange 12 thermally expands, the position of the bolt hole 36 moves from point P to point P'. Point P' is located on the center axis L' of the bolt hole 36 after the fastening structure 100 thermally expanded. The amount of deformation "Δx" of the flange 12 in the axial direction of the bolt 50 is measured in the axial direction of the bolt 50 with reference to point P. The distance from point P to point P' is equal to "$1\times\alpha_f\times\Delta T_f$". This means that the flange 12 stretched in the axial direction of the bolt 50 by an amount corresponding to "$1\times\alpha_f\times\Delta T_f\times\sin\theta$" when measured in the axial direction of the bolt 50 with reference to point P. Further, if the flange 12 were not constrained by the nut 52, thermal expansion of the flange 12 in the axial direction of the bolt 50 will stretch the flange 12 in the axial direction of the bolt 50 by an amount corresponding to "$x_0\times\alpha_f\times\Delta T_f$". Therefore, the amount of deformation of the flange 12 when the flange 12 is not constrained by the nut 52 is equal to "$(x_0+l\times\sin\theta)\alpha_f\times\Delta T_f$".

The above-described $K_f$ is expressed by following Equation (5).

$$K_f = \frac{AE}{x_0} \tag{5}$$

"E" represents a Young's modulus of the flange 12. "Δ" represents a cross-sectional area of a part of the flange 12 that is held between the cylinder head 30 and the nut 52.

Figure 10:
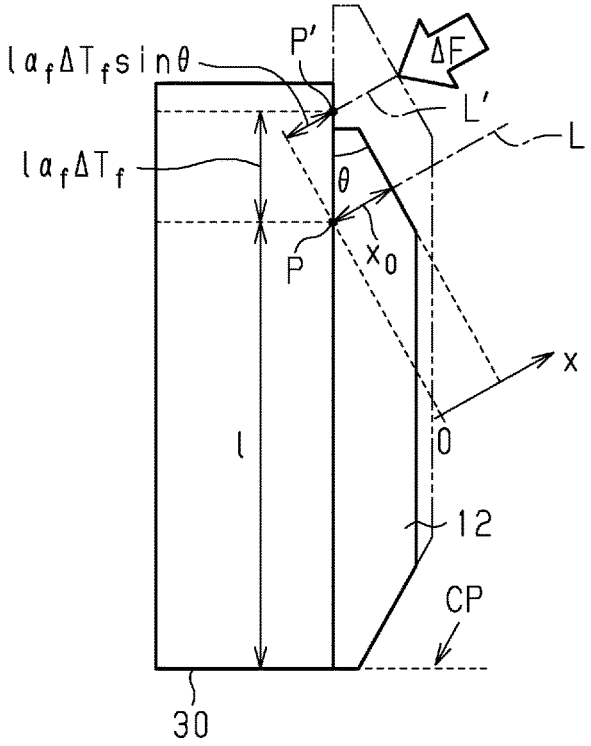
FIG. 10 is a diagram illustrating thermal expansion of the flange of the fastening structure shown in FIG. 1.
Figure 11:
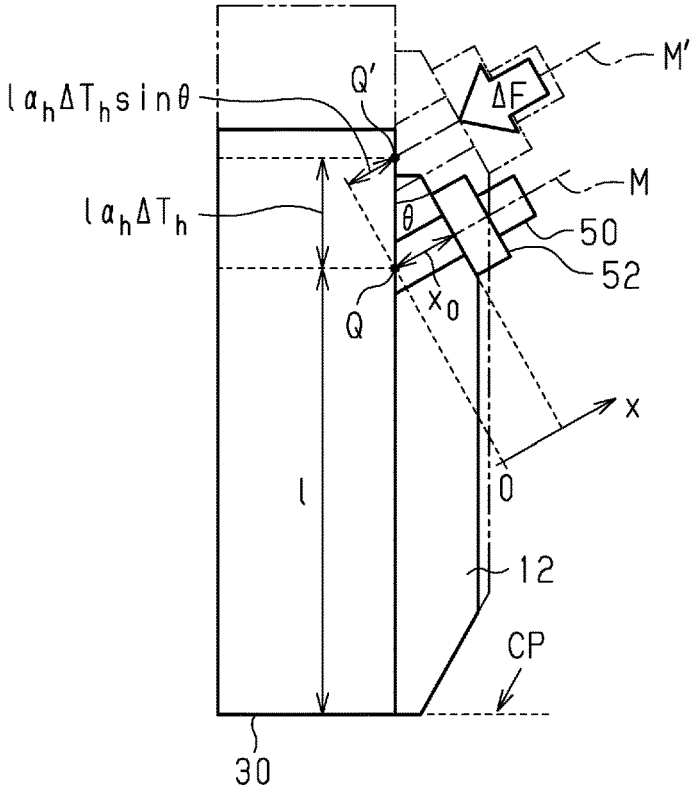
FIG. 11 is a diagram illustrating thermal expansion of the flange of the fastening structure shown in FIG. 1.

Thermal expansion of the fastening structure 100 shifts the contact point of the nut 52 and the flange 12. Specifically, when the fastening structure 100 thermally expands, the thickness of the flange 12 changes at a part where the flange 12 is held between the cylinder head 30 and the nut 52. Such a part will be referred to as the held part. The thickness change of the held part varies the spring constant of the flange 12 from $K_f$ to $K_f'$. Thermal expansion of the flange 12 and the cylinder head 30 causes the thickness change of the held part. As shown in FIG. 10, thermal expansion of the flange 12 increases the thickness of the held part by an amount corresponding to "$l\times\alpha_f\times\Delta T_f\times\sin\theta$". As shown in FIG. 11, thermal expansion of the cylinder head 30 acts to cancel the change in the thickness of the held part caused by thermal expansion of the flange 12. Specifically, thermal expansion of the cylinder head 30 decreases the thickness of the held part by an amount corresponding to "$l\times\alpha_h\times\Delta T_h\times\sin\theta$". This obtains the following Equation (6) regarding $K_f'$.

$$K_f' = \frac{AE}{x_0 + l\sin\theta(\alpha_f\Delta T_f - \alpha_h\Delta T_h)} = K_f\cdot\frac{x_0}{x_0 + l\sin\theta(\alpha_f\Delta T_f - \alpha_h\Delta T_h)} \tag{6}$$

Thermal expansion increases the force of the nut 52 that presses the flange 12.

During thermal expansion, a balanced state is obtained in which the force of the nut 52 that presses the flange 12 changes by "ΔF" and the thickness of the flange 12 changes by "Δx". Such a balanced state is shown in FIG. 8. The following Equation (7) related to the amount of deformation "Δx" of the flange 12 in the axial direction of the bolt 50 is obtained through consideration of thermal expansion in the same manner as the above typical fastening structure.

$$\Delta x = (x_0 + l\sin\theta)\alpha_f\Delta T_f - \frac{\Delta F}{K_f}\cdot\frac{x_0 + l\sin\theta(\alpha_f\Delta T_f - \alpha_h\Delta T_h)}{x_0} \tag{7}$$

Figure 12:
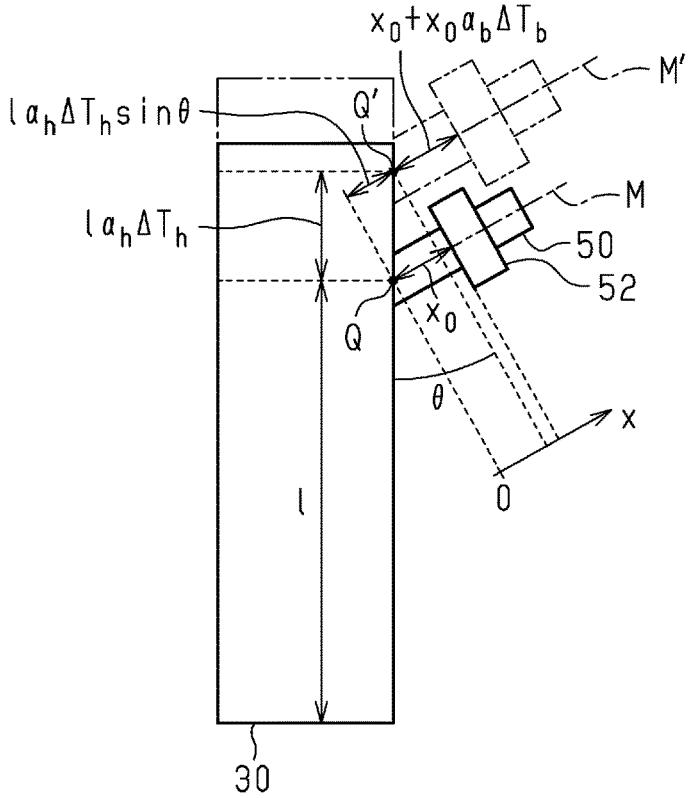
FIG. 12 is a diagram illustrating thermal expansion of the bolt of the fastening structure shown in FIG. 1.

Next, the bolt 50 will be discussed. As shown in FIG. 12, the position of the basal end of the bolt 50 moves from point Q to point Q' as the fastening structure 100 thermally expands. Point Q' is located on the central axis M' of the bolt 50 after the fastening structure 100 thermally expanded. The amount of deformation "Δx" of the bolt 50 in the axial direction of the bolt 50 is measured in the axial direction of the bolt 50 with reference to point P.

As the cylinder head 30 thermally expands, the position of the basal end of the bolt 50 moves by an amount corresponding to "$1\times\alpha_h\times\Delta T_h$". This means that the bolt 50 is stretched by an amount corresponding to "$1\times\alpha_h\times\Delta T_h\times\sin\theta$" when measured in the axial direction of the bolt 50 with reference to point Q.

Figure 13:
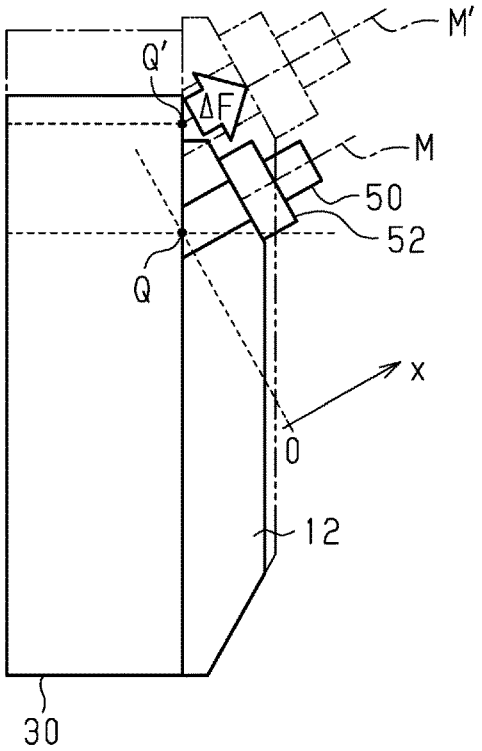
FIG. 13 is a diagram showing a force applied to the bolt after the fastening structure shown in FIG. 1 thermally expanded.

Thermal expansion produces the force with the flange 12 that stretches the bolt 50 through the nut 52. This obtains a balanced state in which the bolt axial force changes by "ΔF" and the length of the bolt 50 changes by "Δx" when the bolt 50 thermally expands. Such a balanced state is shown in FIG. 13. The following Equation (8) related to the amount of deformation "Δx" of the bolt 50 in the axial direction of the bolt 50 is obtained through consideration of thermal expansion in the same manner as the above typical fastening structure.

$$\Delta x = x_0\alpha_b\Delta T_b + l\sin\theta\cdot\alpha_h\Delta T_h + \frac{\Delta F}{K_b} \tag{8}$$

The following Equation (9) is obtained from Equations (7) and (8).

$$\Delta F = \frac{K_b K_f x_0 \{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)} \quad (9)$$

The following Equation (10) is obtained from Equations (8) and (9).

$$\Delta x = x_0 \alpha_b \Delta T_b + l\sin\theta \cdot \alpha_h \Delta T_h + \frac{K_f x_0 \{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)} \quad (10)$$

It is desirable that "ΔF" be less than "$F_C$", "Δx" be less than "$\Delta x_c$", and the strain "ε" of the bolt 50 be less than "$\varepsilon_{bc}$". This is to avoid plastic deformation of the cylinder head 30, the flange 12, and the bolt 50. The strain "ε" of the bolt 50 is expressed by "$\Delta x/x_0$". This obtains the following Equation (11).

$$\left.\begin{aligned} \Delta F &< F_c \\ \Delta x &< \Delta x_c \\ \varepsilon = \frac{\Delta x}{x_0} &< \varepsilon_{bc} \end{aligned}\right\} \quad (11)$$

The fastening structure 100 is designed to satisfy Equations (9), (10), and (11).

Advantages of Present Embodiment (1) With the present embodiment, the design of the fastening structure 100 properly reflects the effects of thermal expansion of the fastening structure 100.

(2) The bolt 50 does not contact the cylinder head 30 inside the bolt hole 36 in a range extending from the coupling surface 32 of the cylinder head 30 to the specified length. This allows deformation of the bolt 50 to be tolerated inside the bolt hole 36 when the fastening structure 100 thermally expands. Thus, as compared to when deformation of the bolt 50 occurs only outside the bolt hole 36, the bolt 50 is less likely to be plastically deformed by thermal expansion.

In other words, the bolt 50 also stretches in a part unconstrained by the cylinder head 30 (in clearance 38). In this manner, the space for expansion of the bolt 50 is ensured and the stress is distributed in a larger range without externally enlarging the fastening structure 100. This avoids plastic deformation and breakage of the bolt 50 caused by thermal expansion. Further, the expansion of the bolt 50 limits increases in the compression force applied to the flange 12, which is the fastened member. This also avoids plastic deformation of the flange 12.

(3) With the present embodiment, the design of the fastening structure 100 properly reflects the effects of thermal expansion of the fastening structure 100. For example, "$x_0$" can be determined based on the parameters other than "$x_0$" such that above Equations (9), (10), and (11) are all satisfied.

Modified Examples

The present embodiment may be modified as follows. The present embodiment and the following modifications can be combined as long as the combined modifications remain technically consistent with each other.

In the above embodiment, the two bolts 40, the two nuts 42, and the lower holder 44 form the fixing member 46. However, this is merely an example. For example, the lower holder 44 and the cylinder head 30 may be a one-piece component.

In the above embodiment, the two bolts 50 and the two nuts 52 fix the second end portion 16 of the flange 12 to the cylinder head 30. However, this is merely an example. The number and arrangement of the bolts 50 and the nuts 52 may be changed.

Instead of the cavity 24 of the above embodiment, the second end portion 16 may include a through hole.

A cylindrical collar may be arranged between the nut 52 and the washer 54.

The washer 54 may be omitted.

In the above embodiment, the clearance 38 is provided inside the bolt hole 36 in order to ensure a sufficient amount of $x_0$. However, the clearance 38 may be omitted as long as a sufficient amount of $x_0$ is ensured under a condition in which Equations (9), (10), and (11) are all satisfied.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A fastening structure that fastens an exhaust manifold to a cylinder head of an engine, the fastening structure comprising:

an exhaust port of the cylinder head, the cylinder head including an opening of the exhaust port that is open to outside of the cylinder head;

a flange arranged on an end of a branch pipe of the exhaust manifold, wherein the flange is fastened to a coupling surface that surrounds the opening of the exhaust port to connect an opening of the exhaust manifold to the opening of the exhaust port, and the flange includes a first end portion and a second end portion that contact the coupling surface and are located at opposite sides of the branch pipe;

a fixing member fixing the first end portion of the flange to the cylinder head;

a bolt extending through the second end portion of the flange, the bolt being inserted into and fixed to a bolt hole of the cylinder head; and a nut fastened to the bolt to fix the second end portion of the flange to the cylinder head, wherein:

a direction orthogonal to the coupling surface that contacts the second end portion of the flange defines a first direction;

a direction in which the first end portion and the second end portion of the flange are located next to each other defines a second direction;

a direction orthogonal to the first direction and the second direction defines a third direction; and as viewed in the third direction, the second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe;

the nut is fastened to the bolt so that a compression force is applied to the inclined surface; and when "$x_0$" represents a length of a part of the bolt that is not in contact with a wall of the bolt hole and is from where the nut applies the compression force to the inclined surface to where the bolt contacts the wall of the bolt hole in a cross section taken along a plane extending along the second direction and a center axis of the bolt when the fastening structure is not thermally expanded;

"$\Delta x$" represents an amount of deformation of the bolt in an axial direction of the bolt resulting from thermal expansion of the fastening structure;

"$\Delta F$" represents an amount of change in the force of the nut that compresses the second end portion resulting from thermal expansion of the fastening structure in the cross section;

"$\theta$" represents an angle of the inclined surface with respect to the contact surface in the cross section;

"l" represents a distance from a distal end of the first end portion of the contact surface of the flange to a center of the bolt hole in the cross section when the fastening structure is not thermally expanded;

"$\alpha_h$" represents a coefficient of linear expansion of the cylinder head in the cross section;

"$\alpha_f$" represents a coefficient of linear expansion of the flange;

"$\alpha_b$" represents a coefficient of linear expansion of the bolt;

"$\Delta T_h$" represents a temperature change of the cylinder head during thermal expansion of the fastening structure;

"$\Delta T_f$" represents a temperature change of the flange during thermal expansion of fastening structure;

"$\Delta T_b$" represents a temperature change of the bolt during thermal expansion of the fastening structure;

"$\kappa_f$" represents a spring constant of the flange at a part where the flange is held between the cylinder head and the bolt in the cross section when the fastening structure is not thermally expanded;

"$K_b$" represents a spring constant of the bolt in the axial direction of the bolt;

"$F_C$" represents a limit load at which any of the cylinder head, the flange, or the bolt undergoes plastic deformation;

"$\Delta x_c$" represents a limit displacement at which any of the flange or the bolt undergoes plastic deformation; and "$\varepsilon_{bc}$" represents a limit strain at which the bolt undergoes plastic deformation in the axial direction of the bolt;

$$\Delta F = \frac{K_b K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta x = x_0\alpha_b \Delta T_b + l\sin\theta \cdot \alpha_h \Delta T_h + \frac{K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta F < F_c$$

$$\Delta x < \Delta x_c$$

$$\varepsilon = \frac{\Delta x}{x_0} < \varepsilon_{bc}$$

the above equations are satisfied.

2. The fastening structure according to claim 1, wherein a clearance is provided between the bolt and the cylinder head inside the bolt hole in a range extending from the coupling surface of the cylinder head to a specified length.

3. A fastening structure that fastens an exhaust manifold to a cylinder head of an engine, the fastening structure comprising:

an exhaust port of the cylinder head, the cylinder head including an opening of the exhaust port that is open to outside of the cylinder head;

a flange arranged on an end of a branch pipe of the exhaust manifold, wherein the flange is fastened to a coupling surface that surrounds the opening of the exhaust port to connect an opening of the exhaust manifold to the opening of the exhaust port, and the flange includes a first end portion and a second end portion that contact the coupling surface and are located at opposite sides of the branch pipe;

a fixing member fixing the first end portion of the flange to the cylinder head;

a bolt extending through the second end portion of the flange, the bolt being inserted into and fixed to a bolt hole of the cylinder head; and a nut fastened to the bolt to fix the second end portion of the flange to the cylinder head, wherein the second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe, and wherein the nut, fastened to the bolt that extends through the inclined surface, contacts the inclined surface; and an unobstructed clearance, provided between the bolt and the cylinder head inside the bolt hole, which extends in a range extending from the coupling surface of the cylinder head to a specified length.

4. A method for designing a fastening structure that fastens an exhaust manifold to a cylinder head of an engine, wherein the fastening structure includes:

an exhaust port of the cylinder head, the cylinder head including an opening of the exhaust port that is open to outside of the cylinder head;

a flange arranged on an end of a branch pipe of the exhaust manifold, wherein the flange is fastened to a coupling surface that surrounds the opening of the exhaust port to connect an opening of the exhaust manifold to the opening of the exhaust port, and the flange includes a first end portion and a second end portion that contact the coupling surface and are located at opposite sides of the branch pipe;

a fixing member fixing the first end portion of the flange to the cylinder head;

a bolt extending through the second end portion of the flange, the bolt being inserted into and fixed to a bolt hole of the cylinder head; and a nut fastened to the bolt to fix the second end portion of the flange to the cylinder head, wherein:

a direction orthogonal to the coupling surface that contacts the second end portion of the flange defines a first direction;

a direction in which the first end portion and the second end portion of the flange are located next to each other defines a second direction;

a direction orthogonal to the first direction and the second direction defines a third direction; and as viewed in the third direction, the second end portion of the flange includes a contact surface that contacts the coupling surface of the cylinder head, and an inclined surface that is inclined with respect to the contact surface such that the inclined surface becomes closer to the contact surface as the inclined surface becomes farther away from the branch pipe;

the nut is fastened to the bolt so that a compression force is applied to the inclined surface; and when "$x_0$" represents a length of a part of the bolt that is not in contact with a wall of the bolt hole and is from where the nut applies the compression force to the inclined surface to where the bolt contacts the wall of the bolt hole in a cross section taken along a plane extending along the second direction and a center axis of the bolt when the fastening structure is not thermally expanded;

"$\Delta x$" represents an amount of deformation of the bolt in an axial direction of the bolt resulting from thermal expansion of the fastening structure;

"$\Delta F$" represents an amount of change in the force of the nut that compresses the second end portion resulting from thermal expansion of the fastening structure in the cross section;

"$\theta$" represents an angle of the inclined surface with respect to the contact surface in the cross section;

"$l$" represents a distance from a distal end of the first end portion of the contact surface of the flange to a center of the bolt hole in the cross section when the fastening structure is not thermally expanded;

"$\alpha_h$" represents a coefficient of linear expansion of the cylinder head in the cross section;

"$\alpha_f$" represents a coefficient of linear expansion of the flange;

"$\alpha_b$" represents a coefficient of linear expansion of the bolt;

"$\Delta T_h$" represents a temperature change of the cylinder head during thermal expansion of the fastening structure;

"$\Delta T_f$" represents a temperature change of the flange during thermal expansion of fastening structure;

"$\Delta T_b$" represents a temperature change of the bolt during thermal expansion of the fastening structure;

"$K_f$" represents a spring constant of the flange at a part where the flange is held between the cylinder head and the bolt in the cross section when the fastening structure is not thermally expanded;

"$K_b$" represents a spring constant of the bolt in the axial direction of the bolt;

"$F_C$" represents a limit load at which any of the cylinder head, the flange, or the bolt undergoes plastic deformation;

"$\Delta x_c$" represents a limit displacement at which any of the flange or the bolt undergoes plastic deformation; and "$\varepsilon_{bc}$" represents a limit strain at which the bolt undergoes plastic deformation in the axial direction of the bolt;

$$\Delta F = \frac{K_b K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta x = x_0 \alpha_b \Delta T_b + l\sin\theta \cdot \alpha_h \Delta T_h + \frac{K_f x_0\{l\sin\theta(\alpha_f \Delta T_f - \alpha_h \Delta T_h) + x_0(\alpha_f \Delta T_f - \alpha_b \Delta T_b)\}}{(K_b + K_f)x_0 + K_b l\sin\theta(\alpha_f \Delta T_f - \alpha_h \Delta T_h)}$$

$$\Delta F < F_c$$

$$\Delta x < \Delta x_c$$

$$\varepsilon = \frac{\Delta x}{x_0} < \varepsilon_{bc}$$

the method comprising designing the fastening structure such that the above equations are satisfied.

* * * * *